United States Patent [19]

Haranoya et al.

[11] Patent Number: 4,886,693

[45] Date of Patent: Dec. 12, 1989

[54] FLOCKED YARN AND METHOD FOR MANUFACTURING

[75] Inventors: Tomoji Haranoya; Shigeki Iwamoto, both of Ashikaga, Japan

[73] Assignee: Toyo Denshoku Kabushiki Kaisha, Tochigi, Japan

[21] Appl. No.: 343,795

[22] Filed: Apr. 27, 1989

[30] Foreign Application Priority Data

Apr. 28, 1988 [JP] Japan ..... 63-104028

[51] Int. Cl.[4] ..... B32B 33/00

[52] U.S. Cl. ..... 428/90; 427/200; 427/206; 428/395; 428/400; 428/401

[58] Field of Search ..... 428/90, 375, 380, 395, 428/397, 400, 401; 427/200, 206

[56] References Cited

U.S. PATENT DOCUMENTS 3,968,283 7/1976 Schutte ..... 428/90

*Primary Examiner*—Marion C. McCamish

*Attorney, Agent, or Firm*—Birch, Stewart, Kolasch & Birch

[57] ABSTRACT

A flocked yarn comprises a core yarn with a total denier of 140–1260, an adhesive applied onto the core yarn at an amount within predetermined range and flock fibers with a cut length of 0.5–3.0 mm which are flocked at a flocking density of not less than 30,000/cm$^2$. The flocked yarn can be obtained by a method wherein for application of flock fibers onto an adhesive layer applied to the core yarn an electrostatic field in which an attractive force operates and an electrostatic field in which a repulsive force operates are applied either alternately by changing the polarity of one of a single pair of electrodes or, in a continuous process, sequentially by arranging two kinds of electrostatic fields. The flocked yarn thus obtained can have a good touch, a high flocking density and a high abrasion resistance.

19 Claims, 3 Drawing Sheets

FLOCKED YARN AND METHOD FOR MANUFACTURING

BACKGROUND OF THE INVENTION

1. Field of the Invention

The present invention relates to a flocked yarn which has a good touch and a high abrasion resistance and which is suitable for use in home interia and various industrial fields and a method for manufacturing the flocked yarn.

2. Description of the Prior Art

For producing a flocked yarn in which flock fibers with a short cut length are flocked onto the surface of a core yarn, various proposals are known. For example, Japanese Utility Model publication Nos. SHO 36-22141, SHO 41-16437 and SHO 47-32904 disclose improved core yarns for a flocked yarn, respectively. Japanese Utility Model publication No. SHO 43-5155 discloses an improved adhesive for use for combining a core yarn and flock fibers. Japanese Utility Model publication No. SHO 52-131073 discloses improved materials for a flocked yarn. JP-B-SHO No. 47-19579, JP-A-SHO No. 51-84955 and JP-A-SHO No. 61-15757 disclose respective apparatuses for manufacturing flocked yarns.

In spite of many proposals such as those above, however, practical use of flocked yarns has not been developed to any great extent. The reason for this is that most of the conventional proposals are mere conceptual ideas and, as yet, a flocked yarn which really satisfies practical requirements for use in various fields has not been obtained. Accordingly, further detailed research has been required to advance the practical use of flocked yarns.

The difficulty of making a flocked yarn which can sufficiently advance its practical use is basically due to the fact that a core yarn is fine and its form is columnar. The difficulties which this brings are considered below.

Flocking which utilizes static electricity is performed such that flock fibers with an electric charge fly along lines of electric force formed in an electrostatic field and parts of the flown flock fibers are forcibly plunged into a layer of an adhesive applied onto the periphery of a core yarn. The flocking is continued until the conveyed flock fibers cannot plunge into the layer of the adhesive because the flock fibers lose their movement by losing their charge by coming into contact with flock fibers already flocked. This state is usually called "fully flocked state". The amount of lines of electric force (electric flux) formed on the surface of a core yarn to be flocked is desirably as uniform as possible over the entire surface of the core yarn in order to achieve the above state (that is, fully flocked state) as early as possible. Even if the amount of lines of electric force formed on the surface of the core yarn to be flocked is slightly nonuniform, it is desirable to be able to fully flock the flock fibers on the core yarn only by extending the flocking time to some extent.

Generally, the electric flux density per unit square of the surface of a substrate material to be flocked can be uniformalized by providing an electrode having a surface shape conforming to that of the substrate material on which the flock fibers are to be anchored, or in a case where the substrate material has a columnar shape, such as a core yarn, by rotating the columnar substrate material (a core yarn). However, since a cylindrical electrode is required and/or a columnar substrate material must be rotated in these methods, these methods have a limitation in the simultaneous treatment of a plurality of substrate materials. Therefore, these methods lack practicality in the production of flocked yarns.

Moreover, when the flock fibers conveyed along lines of electric force are plunged into the layer of the adhesive on the core yarn as described above, the flock fibers often cannot be plunged sufficiently deeply into the layer of the adhesive because the flock fibers already flocked obstruct the flocking of newly introduced flock fibers, particularly in the case of a core yarn having a columnar shape. As a result, losing flock fibers is liable to occur.

Therefore, in the conventional flocking methods for flocked yarns, nonuniformity of flocking is liable to occur, flocking density is not sufficient and the depth of anchor of flock fibers into a layer of an adhesive on a core yarn tends not to be enough. As a result, not only is the quality of a conventional flocked yarn poor, but also its properties, such as abrasion resistance, etc. and its productivity are not good. These defects in the conventional flocking methods and the conventional flocked yarns are the reasons why such flocked yarns cannot serve a practical use.

SUMMARY OF THE INVENTION

An object of the present invention is to provide a flocked yarn the flocking density of which is enough and uniform, the flock fibers of which are strongly combined with a core yarn and which has a good touch, high abrasion resistance and high productivity, and to provide a method for manufacturing such a flocked yarn.

To accomplish the above object, a flocked yarn according to the present invention comprises a core yarn the total denier of which is in the range of 140–1260 (about 154–1386 d tex), a layer of adhesive applied onto the periphery of the core yarn, and flock fibers with a length of 0.5–3.0 mm which are flocked onto the layer of adhesive at a flocking density of at least 30,000/cm$^2$, the weight in grams A of adhesive per 9,000 m of core yarn satisfying the equation:

$$27.5\sqrt{D} \leqq A \leqq 72.5\sqrt{D} \qquad \text{(I)}$$

In equation (I), D is the total denier of the core yarn.

A method for manufacturing a flocked yarn according to the present invention comprises the steps of applying a layer of adhesive onto a core yarn, the total denier of which is in the range of 140–1260 (about 154–1386 d tex) in an amount by weight satisfying the equation (I), flocking flock fibers onto the layer of adhesive by a method in which flocking of the flock fibers onto the adhesive layer is controlled by subjecting the fibers, in turn, to an electrostatic field in which an attractive force operates and an electrostatic field in which a repulsive force operates.

This controlled flocking may be carried out by a method (1) which comprises:

(i) disposing the core yarn between a pair of electrodes, (ii) applying to the electrodes respective voltages which are such as to provide an electrostatic field in which the attractive force operates, and thereafter (iii) applying to the electrodes respective voltages which are such as to provide the electrostatic field in which the repulsive force operates.

Step (iii) may be carried out merely by changing the polarity of one of the electrodes after the performance of step (ii).

The method lends itself particularly to a continuous process in which the steps (ii) and (iii) are carried out alternately at respective intervals of time as the core yarn passes continuously between the electrodes.

Step (ii) may be carried out by applying a positive voltage to one of the pair of electrodes, and a negative voltage to the other of the pair of electrodes, and step (iii) may be carried out by changing the polarity of the voltage applied to one of these electrodes so that an electrostatic field in which an attractive force and a repulsive force alternately operate is formed between the pair of electrodes by the pole change of one of the pair of electrodes.

An alternative continuous method (2) of flocking comprises:

(i) passing the core yarn between at least a first pair of electrodes and a second pair of electrodes downstream of the first pair and, during this passage, (ii) applying to the electrodes of the first pair respective voltages which are such as to provide the electrostatic field in which the attractive force operates, and (iii) applying to the electrodes of the second pair respective voltages which are such as to provide the electrostatic field in which the repulsive force operates.

In the first pair of electrodes, a positive voltage may be applied to one such electrode, and a negative voltage to the other so that an electrostatic field in which an attractive force operates is formed between the electrodes of the first pair, and in the second pair of electrodes, one of a positive voltage and a negative voltage may be applied to both electrodes so that an electrostatic field in which a repulsive force operates is formed between the second pair of electrodes. On the contrary, it is possible to change the order of steps (ii) and (iii) in this case. Namely, a first pair of electrodes generate the electrostatic field in which the repulsive force operates and a second pair of electrodes generate the electrostatic field in which the attractive force operates.

Whichever of the above flocking methods is employed, in the method according to the present invention for the manufacture of a flocked yarn, a core yarn to which an adhesive has been applied is introduced between at least one pair of electrodes which face each other, and flock fibers are flocked by utilizing two kinds of electrostatic field systems in combination. In a first electrostatic field system which is usually used, a positive voltage is applied to one of the pair of electrodes and a negative voltage is applied to the other of the pair of electrodes. Because of the attractive force between electrodes of the pair, attractive lines of electric force are formed, and the flock fibers are conveyed to the core yarn along these attractive lines of electric force. In a second electrostatic field system, a positive or negative voltage is applied to both electrodes of the pair. Because of the repulsive force between the electrodes of the pair, repulsive lines of electric force are formed and the flock fibers are conveyed to the core yarn along the repulsive lines of electric force.

The flock fibers are flocked on the periphery of the core yarn at a uniform and high flocking density by using the two kinds of electrostatic field systems in combination. By this method and by controlling the adherent amount of adhesive within the range given by equation (I) in accordance with the method of the present invention, a good flocked yarn may be obtained wherein flock fibers with a cut length of 0.5–3.0 mm are flocked, at a flocking density of at least 30,000/cm$^2$, onto a core yarn the total denier of which is in the range of 140–1260 (about 154–1386 d tex).

In the method of the present invention, the arrangement of electrodes is not particularly restricted. A pair of electrodes may be arranged in vertical direction or in a horizontal direction. Moreover, two or more pairs of electrodes may be arranged in the running direction of a core yarn, as long as at least a pair of electrodes form an electrostatic field therebetween in which an attractive force operates and at least another pair of electrodes form an electrostatic field therebetween in which a repulsive force operates. Furthermore, in the pair of electrodes forming an electrostatic field in which an attractive force operates, a positive or negative voltage may be applied to one of the pair of electrodes and the other of the pair of electrodes may be grounded.

In the method according to the present invention, desirably a plurality of core yarns are simultaneously introduced between a pair of electrodes from the viewpoint of productivity. The plurality of core yarns may be arranged in a single plane or may be arranged in many planes.

The flock fibers are conveyed along lines of electric force formed in electrostatic fields in which an attractive force operates and in which a repulsive force operates, and the conveyed flock fibers are plunged into and flocked onto a layer of an adhesive applied onto a core yarn which has been introduced into the electrostatic fields. The intervals of the time (cycle) for which the attractive force operates and the time for which the repulsive force operates may be decided in dependence upon the particular characteristics of flock fibers and core yarn to be used, and are not particularly restricted because a sufficiently adequate operation can often be achieved even if the intervals (cycle) are (is) relatively short.

A sufficient amount of flock fibers must be suspended in the electrostatic fields, that is, a sufficient flock fiber mist must be formed in the electrostatic fields, in order to obtain satisfactory flocking density of a flocked yarn. There are two typical systems which form this high level flock fiber mist. One is the so-called "down flow" system wherein flock fibers are supplied downwardly to an electrostatic field and the other is the so-called "up flow" system wherein flock fibers are supplied upwardly to an electrostatic field. In the down flow system, a conventional flock fiber dropping apparatus may be used. For us in the up flow system, there are methods for lifting flock fibers upwardly by an attraction electrode and by an upward air flow, and further by combining these two methods. However, the system for forming the flock fiber mist is not restricted by the above systems or methods.

In the flocked yarn in accordance with present invention, the adherent amount of adhesive on a core yarn must satisfy the equation (I) to achieve a sufficient penetration of the flock fibers into the layer of adhesive on the core yarn:

$$27.5\sqrt{D} \leqq A \leqq 72.5\sqrt{D} \qquad \text{(I)}$$

Further, the equation (II) is preferably satisfied:

$$.35\sqrt{D} \leqq A \leqq 65\sqrt{D} \quad \text{(II)}$$

In the equations (I) and (II), D is the total denier of the core yarn and A is the weight (g) of the adhesive per 9,000 m of core yarn.

The amount of adhesive determined by equation (I) is fairly large in comparison with the amount of adhesive which is used in the conventional manufacturing of a flocked yarn. If the amount of adhesive is smaller than the above amount determined by equation (I), it is difficult to cause penetration of the flock fibers into the layer of adhesive with a sufficient penetration depth because the core yarn generally has a fine columnar shape and the flock fibers already flocked obstruct the penetration of new flock fibers. If the amount of adhesive is larger than the above amount determined by equation (I), it is required to increase the viscosity of the adhesive in order to form and maintain a uniform and concentric circles layers of adhesive around the core yarn. However, when such a high-viscosity adhesive is used, flock fibers become difficult to anchor to the adhesive layer and to penetrate sufficiently into the layer. Thus, the adequate range of the amount of adhesive is determined as represented by equation (I).

The total denier of a core yarn of a flocked yarn according to the present invention must be at least 140 (about 154 d tex) from the viewpoint of ensuring its sufficient tensile strength and abrasion resistance. On the other hand, the total denier must be at the highest 1260 (about 1386 d tex) in order to make the handling and treatment of the core yarn easy and in order to obtain a flocked yarn having a good feeling ("touch"). The total denier of the core yarn is preferably in the range of 210–840 (about 231–924 d tex).

The core yarn is usually constructed of a plurality of individual fibers. The denier of the individual fiber is usually in the range of 0.5–10 (about 0.55–11 d tex), but it is not particularly restricted.

The cut length of flock fibers must be at least 0.5 mm because it becomes difficult to obtain a flocked yarn having a good touch and a high abrasion resistance if the cut length is shorter than the above figure. On the other hand, the cut length of flock fibers must be at longest 3.0 mm because it becomes difficult to anchor the flock fibers into the layer of adhesive with a sufficient depth and the flocking density of the flock fibers decreases if the cut length is greater than the above figure. The cut length of the flock fibers is preferably in the range of 0.7–2.0 mm.

The denier of a flock fiber is not particularly restricted, but it is preferably in the range of 1–15 (about 1.1 to 16.5 d tex) from the viewpoint of ensuring a good touch of an obtained flocked yarn.

The materials for the core yarn and flock fibers according to the present invention are not particularly restricted and various materials can be applied, for example, a natural fiber such as a cotton, wool or bast fiber, a synthetic fiber such as a polyester fiber, a polyamide fiber or an acrylic fiber, a regenerated cellulose fiber such as a rayon, a Bemberg (a trademark), a semi-synthetic fiber such as an acetate or a protein fiber, and an inorganic fiber such as a carbon fiber or a glass fiber, etc. The core yarn and the flock fibers are desirably constructed from an identical material, and the material is preferably a synthetic fiber represented particularly by a nylon fiber having a high elasticity against compression. However, the materials of the core yarn and flock fibers may be different from each other.

The adhesive combining a core yarn and flock fibers may be any adhesive which can strongly combine the material of the core yarn and the material of the flock fibers and which does not impair flexibility and good touch of an obtained flocked yarn. Preferably, the adhesive is one of an acrylic ester adhesive and a urethane adhesive.

In methods of the present invention, an optimum amount of adhesive may be applied to a core yarn, the flying direction of the flock fibers is adequately changed in the electrostatic fields in which both an attractive force and a repulsive force operate, and the flock fibers are anchored onto the layer of an adhesive with a high flocking density and a sufficient penetration depth. Therefore, a flocked yarn in which the flock fibers are uniformly flocked and which has a high flocking density and a good touch can be obtained. Further, since the flock fibers are sufficiently and strongly combined with the core yarn, the obtained flocked yarn can have a high abrasion resistance.

BRIEF DESCRIPTION OF THE DRAWINGS

Some preferred exemplary embodiments of the invention will now be described with reference to the accompanying drawings which are given by way of example only, and in which.

DETAILED DESCRIPTION OF THE INVENTION

Figure 1:
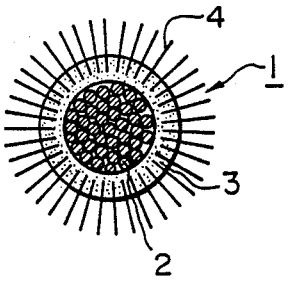
FIG. 1 is a cross-sectional view of a flocked yarn according to an embodiment of the present invention.

FIG. 1 schematically illustrates the cross section of a flocked yarn 1 according to an embodiment of the present invention. Flocked yarn 1 comprises a core yarn 2 which is constructed of multifilaments and the total denier of which is in the range of 140–1260 (about 154–1386 d tex), a layer of an adhesive 3 applied onto the periphery of the core yarn, and flock fibers 4 flocked onto the layer of the adhesive. The cut length of flock fibers 4 is in the range of 0.5–3.0 mm. Flock fibers 4 are flocked at a flocking density of at least 30,000/cm$^2$. The adherent amount of adhesive 3 satisfies the aforementioned equation (I).

Figure 2:
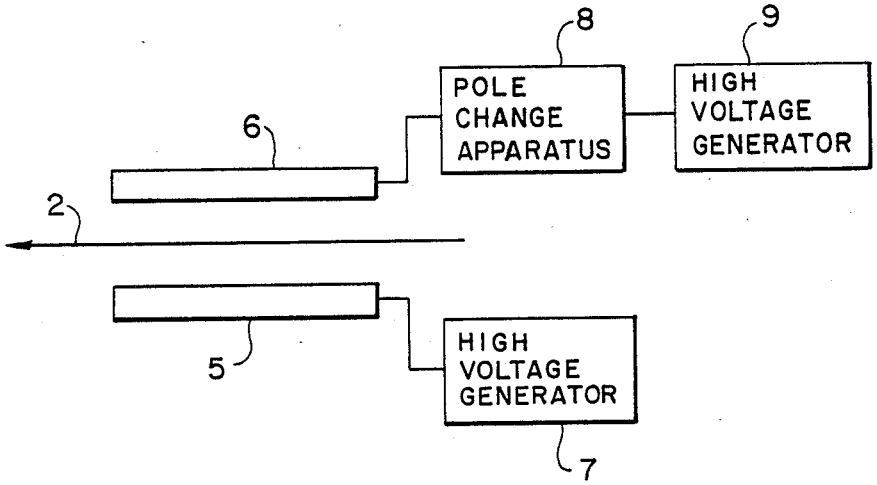
FIG. 2 is a schematic side view of a pair of electrodes with a pole change means used for a method according to an embodiment of the present invention.

FIG. 2 schematically illustrates a pair of electrodes 5 and 6. Core yarn 2 applied with adhesive 3 is passed between electrodes 5 and 6. A high voltage generator 7 is connected to lower electrode 5 and a positive or negative predetermined constant voltage is applied to the lower electrode in this embodiment. A high voltage generator 9 is connected to upper electrode 6 via a pole change apparatus 8. The polarity of the voltage applied to upper electrode 6 by high voltage generator 9 is switched alternately positive and negative at a predetermined interval.

Figure 3A:
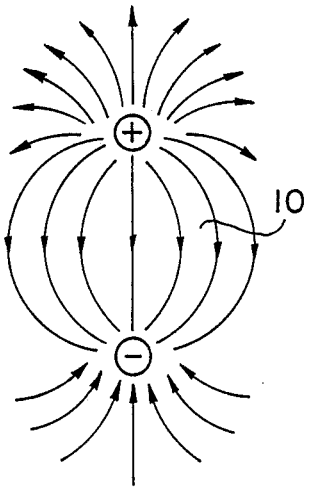
FIG. 3A is a schematic view showing lines of electric force in an electrostatic field in which an attractive force operates.
Figure 3B:
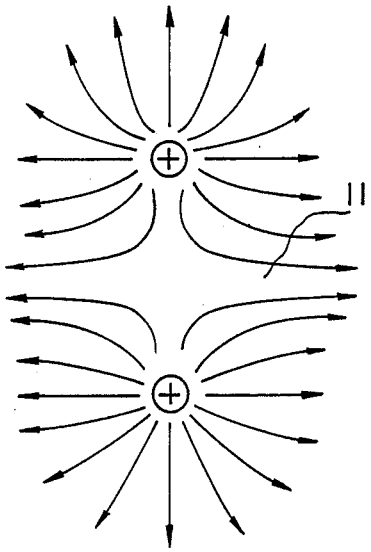
FIGS. 3B and 3C are schematic views showing lines of electric force in an electrostatic field in which a repulsive force operates.
Figure 3C:
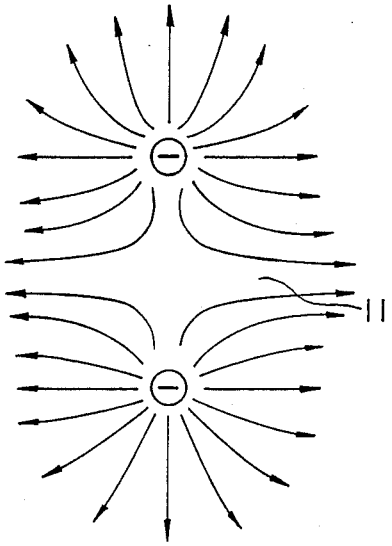

When the voltage applied to one of electrodes 5 and 6 is positive and the voltage applied to the other electrode is negative, lines of electric force are generated as shown in FIG. 3A and an electrostatic field 10 in which an attractive force operates results. When the polarities of both electrodes 5 and 6 are identical, lines of electric force are generated, as shown in FIG. 3B or 3C, and an electrostatic field 11 in which a repulsive force operates results. Core yarn 2 covered with adhesive 3 is passed between these electrodes 5 and 6 in which electrostatic fields 10 and 11 are alternately made. Flock fibers 4 are conveyed along such lines of electric force as shown in FIG. 3A and FIG. 3B or 3C and flocked onto the layer of adhesive 3 on core yarn 2.

Figure 4:
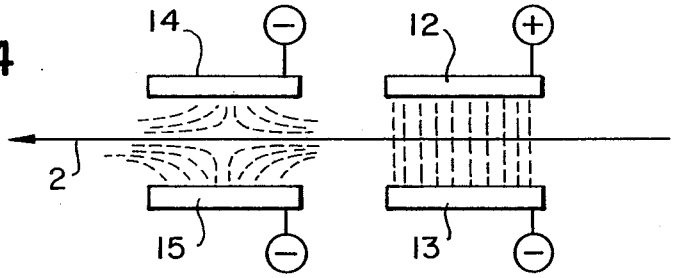
FIG. 4 is a schematic side view of a pair of electrodes generating an attractive force and a pair of electrodes generating a repulsive force which are arranged in a running direction of a core yarn.

Electrodes may be arranged as shown in FIG. 4. In the arrangement shown in FIG. 4, two pairs of electrodes are arranged in the running direction of core yarn 2. In a first such pair of electrodes 12 and 13, a positive voltage is applied to one of the electrodes and a negative voltage is applied to the other of the electrodes so that an attractive force is generated between the electrodes, while in a second pair of electrodes 14 and 15 a positive or negative voltage is applied to both electrodes so that a repulsive force is generated between the electrodes. In this system, flocking by utilizing an attractive force and flocking by utilizing a repulsive force are successively conducted.

Figure 5:
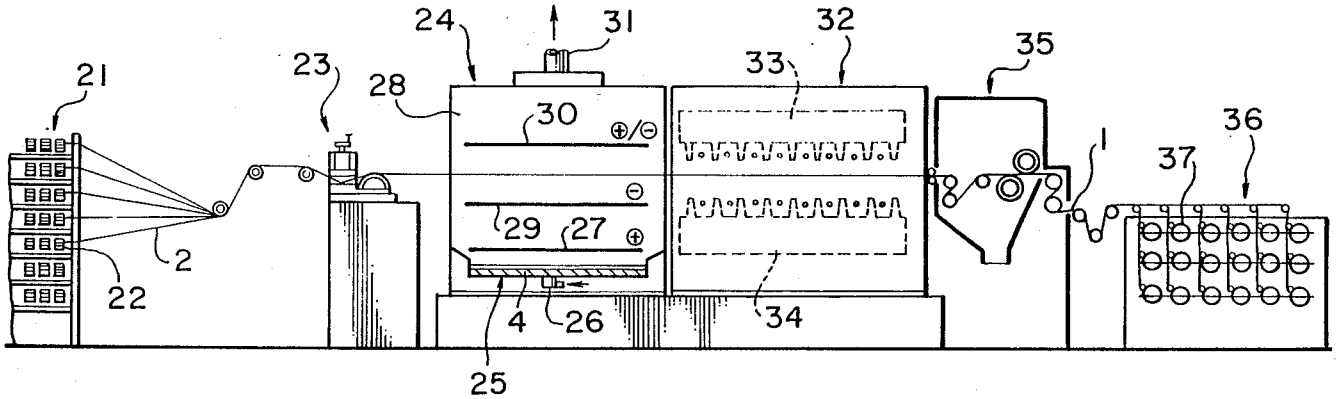
FIG. 5 is a schematic side view of an entire manufacturing process of a flocked yarn according to a furthe embodiment of the present invention.

FIG. 5 illustrates an entire process for manufacturing a flocked yarn according to the present invention. A plurality of core yarns 2 are unwound and untwisted from a plurality of reels 22 in a let-off motion at 21 and sent to a coater 23. An adhesive is applied to respective core yarns 2 in a predetermined amount (within the range of equation (I)) in coater 23, and the core yarns covered with the adhesive are sent to a flocking apparatus 24. This flocking apparatus 24 is of the up flow type and is equipped with a pile containing box 25 at a bottom portion thereof. Flock fibers 4 present in the pile containing box 25 are suspended as a flock fiber mist in a flocking room 28 by being blown up by a flow of air supplied from an air inlet 26 and by upward attraction by a lift electrode 27 provided above the pile containing box.

Core yarns 2 covered with the adhesive are passed between a lower electrode 29 and an upper electrode 30. A constant negative voltage is applied to lower electrode 29 and a positive voltage and a negative voltage which are switched by a pole change means are alternately applied to upper electrode 30 at predetermined intervals of time. An electrostatic field in which an attractive force operates and an electrostatic field in which a repulsive force operates are formed between electrodes 29 and 30, and suspended flock fibers 4 fly along lines of electric force generated in respective electrostatic fields and are plunged into and flocked onto the layer of the adhesive on core yarns 2. Air supplied for blowing up and suspending flock fibers 4 is appropriately exhausted from an air outlet 31 and recirculated into flocking room 28.

Flocked yarns 1 flocked in flocking apparatus 24 are successively sent to a dryer 32. In this embodiment, flocked yarns 1 are dried by hot air from an upper nozzle 33 and a lower nozzle 34. Dried flocked yarns 1 are sent to a depilator 35 which can eliminate loose flock fibers from the flocked yarns. Flocked yarns 1 made so as to satisfy a desired specification are wound onto respective paper tubes 37 driven by a winder 36.

PREFERRED EMBODIMENTS

Examples 1–6 and Comparative Examples 1–8

Core yarns which have various total deniers (D) as shown in the following Table are made from nylon fibers the individual fiber of which has a denier of (3.3 d tex). An acrylic ester adhesive is applied to these core yarns. The core yarns covered with the adhesive are passed through a position mid-way between an upper electrode and a lower electrode at a speed of 5 m/min. A constant negative voltage of −30 KV is applied to the lower electrode. In all of the Examples and Comparative Examples (except Comparative Examples 3 and 7), the polarity of the upper electrode is changed by a pole change means, and a positive voltage of +30 KV and a negative voltage of −30 KV are alternately applied at an interval of 5 sec. Thus, an electrostatic field in which an attractive force operates and an electrostatic field in which a repulsive force operates are formed in these Examples and Comparative Examples. In Comparative Examples 3 and 7, the polarity of the upper electrode is fixed, a constant positive voltage of +30 KV being applied. Thus, in Comparative Examples 3 and 7 a single electrostatic field in which an attractive force operates is applied.

The flock fibers used in all Examples and Comparative Examples are made by treating fibers of nylon 6 with alkylphosphate silicic acid soda containing a calcium salt, and dehydrating and drying the treated fibers. Flock fibers of 3 d (3.3 d tex)×1.0 mm are used in all Examples and Comparative Examples, except for Comparative Examples 4 and 5, for which flock fibers of 3 d×0.4 mm and 3 d×3.2 mm are used respectively. These flock fibers formed a flock fiber mist between the upper and lower electrodes using an apparatus such as that shown in FIG. 5. Flocked yarns after flocking are dried at a temperature of 120° C. Thus, the flocked yarns shown in the Table are obtained.

In Comparative Examples 1 and 8, the core yarn deniers lie respectively below and above the range thereof required for a flocked yarn in accordance with the present invention.

In Comparative Examples 4 and 5 the cut lengths of the flock fibers lie respectively below and above the range thereof required for a flocked yarn in accordance with the present invention.

In Comparative Examples 2 and 6 the adhesive weight lies below the minimum required for a flocked yarn in accordance with the present invention.

In the Table, the symbols have the following meaning:

o:excellent
Δ: good
x:poor

As is evident from the Table, the flocked yarns according to the present invention, in comparison with the flocked yarns obtained in the Comparative Examples, have large and uniform flocking densities and good touch, and have high abrasion resistances because flock fibers are strongly combined with the core yarns. Accordingly, durable and high-quality sheet fabric, suit material, decoration fabric, embroidery thread, knitting yarn and braid can be obtained by using these kinds of flocked yarns according to the present invention.

TABLE

| Example and Comparative Example No. | Flocking system* | Condition: Flock fiber denier (d tex) × length | Condition: Core yarn (D) denier (d tex) | Condition: Adhesive weight (g) | Flock fiber adhering stage | Flocking Density (/cm²) | Quality: Touch | Quality: Abrasion Resistance | Quality: Total Evaluation |
|---|---|---|---|---|---|---|---|---|---|
| Comp. 1 | A | 3d(3.3) × 1.0 mm | 110 (121) | 500 | Δ | 22,500 | x | x | x |
| Exam. 1 | A | 3d(3.3) × 1.0 mm | 140 (154) | 580 | o | 30,200 | Δ | o | Δ |
| Exam. 2 | A | 3d(3.3) × 1.0 mm | 210 (231) | 730 | o | 34,500 | o | o | o |
| Exam. 3 | A | 3d(3.3) × 1.0 mm | 420 (462) | 983 | o | 36,000 | o | o | o |
| Comp. 2 | A | 3d(3.3) × 1.0 mm | 420 (462) | 560 | Δ | 28,000 | Δ | x | x |
| Comp. 3 | B | 3d(3.3) × 1.0 mm | 420 (462) | 983 | x | 21,000 | x | x | x |
| Comp. 4 | A | 3d(3.3) × 0.4 mm | 630 (693) | 1,550 | Δ | 25,000 | x | Δ | x |
| Exam. 4 | A | 3d(3.3) × 1.0 mm | 630 (693) | 1,560 | o | 35,500 | o | o | o |
| Comp. 5 | A | 3d(3.3) × 3.2 mm | 630 (693) | 1,540 | x | 18,500 | x | x | x |
| Comp. 6 | A | 3d(3.3) × 1.0 mm | 630 (693) | 680 | Δ | 28,500 | Δ | x | x |
| Comp. 7 | B | 3d(3.3) × 1.0 mm | 630 (693) | 1,560 | x | 20,500 | x | x | x |
| Exam. 5 | A | 3d(3.3) × 1.0 mm | 840 (924) | 1,450 | o | 37,000 | o | o | o |
| Exam. 6 | A | 3d(3.3) × 1.0 mm | 1,260 (1,386) | 1,780 | o | 33,000 | Δ | o | Δ |
| Comp. 8 | A | 3d(3.3) × 1.0 mm | 1,680 (1,848) | 2,060 | Δ | 29,000 | x | Δ | x |

*(Note)
A — Attractive force and repulsive force operate.
B — Only attractive force operates.

Although only several preferred embodiments of the present invention have been described herein in detail, it will be appreciated by those skilled in the art that various modifications and alterations can be made to this embodiment without materially departing from the novel teachings and advantages of this invention. Accordingly, it is to be understood that all such modifications and alterations are included within the scope of the invention as defined by the following claims.

What is claimed is:

1. A flocked yarn comprising:

a core yarn the total denier of which is in the range of 140–1260 (154–1386 d tex);

a layer of adhesive applied onto the periphery of said core yarn; and flock fibers with a length of 0.5–3.0 mm which are flocked onto the layer of adhesive at a flocking density of at least 30,000/cm², the weight in grams A of adhesive per 9,000 m of core yarn satisfying the equation (I)

$$27.5\sqrt{D} \leqq A \leqq 72.5\sqrt{D} \quad \text{(I)}$$

wherein D is the total denier of the corn yarn.

2. The flocked yarn according to claim 1, wherein the total denier of said core yarn is in the range of 210–840 (231–924 d tex).

3. The flocked yarn according to claim 1, wherein the denier of each of individual fiber constituting said core yarn is in the range of 0.5–10 (0.55–11 d tex).

4. The flocked yarn according to claim 1, wherein the denier of said flock fibers is in the range of 1–15 (1.1–16.5 d tex).

5. The flocked yarn according to claim 1, wherein said flock fibers have a cut length of 0.7–2.0 mm.

6. The flocked yarn according to claim 1, wherein the denier of said core yarn and the weight of the said adhesive per 9,000 m of core yarn satisfy the equation (II), $$35\sqrt{D} \leqq A \leqq 65\sqrt{D} \quad \text{(II)}$$

wherein D and A are as defined in claim 1.

7. The flocked yarn according to claim 1, wherein said adhesive is an acrylic ester adhesive or a urethane adhesive.

8. A method for manufacturing a flocked yarn comprising the steps of:

applying a layer of adhesive onto a core yarn, the total denier of which is in the range of 140–1260 (154–1386 d tex), in an amount by weight satisfying the equation (I), $$27.5\sqrt{D} \leqq A \leqq 72.5\sqrt{D} \quad \text{(I)}$$

wherein D is the total denier of said core yarn and A is the weight (g) of said adhesive per 9,000 m of said core yarn; and flocking flock fibers onto the layer of adhesive and controlling the flocking by subjecting the flock fibers in turn (a) to an electrostatic field in which an attractive force operates and thereafter (b) to an electrostatic field in which a repulsive force operates.

9. The method according to claim 8, wherein the said flocking step comprises (i) disposing the core yarn between at least one pair of electrodes, (ii) applying to the said electrodes respective voltages which are such as to provide the said electrostatic field in which the attractive force operates, and thereafter (iii) applying to the said electrodes respective voltages which are such as to provide the said electrostatic field in which the repulsive force operates.

10. The method according to claim 9, wherein the step (iii) is carried out by changing the polarity of one of the said pair of electrodes after performance of step (ii).

11. The method according to claim 9, wherein the step (ii) and (iii) are carried out alternately for respective intervals of time as the core yarn passes continuously between the electrodes.

12. The method according to claim 11, wherein the said flocking step comprises (i) passing the core yarn between at least a first pair of electrodes and a second pair of electrodes downstream of the said first pair and, during the said passage, (ii) applying to the electrodes of the said first pair respective voltages which are such as to provide the said electrostatic field in which the attractive force operates, and (iii) applying to the electrodes of the said second pair respective voltages which are such as to provide the said electrostatic field in which the repulsive force operates.

13. The method according to claim 9, wherein said flock fibers are supplied downwardly to a position between the or each said pair of electrodes.

14. The method according to claim 9, wherein said flock fibers are supplied upwardly to a position between the or each said pair of electrodes.

15. The method according to claim 9, wherein one of said pair of electrodes forming said electrostatic field in which attractive forces operate is grounded.

16. The method according to claim 8, wherein said flock fibers are flocked at a flocking density of at least 30,000/cm$^2$.

17. The method according to claims 8, wherein said flock fibers have a cut length of 0.5–3.0 mm.

18. The method according to claim 8 further comprising the step of drying said flocked yarn after said flocking.

19. The method according to claim 8, wherein a plurality of said core yarns are substantially simultaneously subjected to the said step of applying the adhesive layer and thereafter to the said step of flocking the flock fibers onto the core yarns.

* * * * *